United States Patent [19]

Koreska

[11] 4,035,979

[45] July 19, 1977

[54] PROFILE RAIL

[76] Inventor: Rudolf Johan Koreska, Adalsparkvej 61, 2970 Horsholm, Denmark

[21] Appl. No.: 557,141

[22] Filed: Mar. 10, 1975

[30] Foreign Application Priority Data

Mar. 8, 1974 Denmark ..... 1266/74

[51] Int. Cl.[2] ..... E04C 3/30

[52] U.S. Cl. ..... 52/737; 52/732

[58] Field of Search ..... 52/656, 721, 758 H, 52/475, 726, 731, 732, 737; 403/169, 231, 263, 401, 402

[56] References Cited

U.S. PATENT DOCUMENTS

| | | | |
|---|---|---|---|
| 2,654,451 | 10/1953 | Schmidgall | 403/402 |
| 2,666 ,508 | 1/1954 | Nardulli | 403/402 |
| 2,804,952 | 9/1957 | Nothdurft | 52/475 |
| 2,918,150 | 12/1959 | Blum | 52/292 |
| 3,288,427 | 11/1966 | Pluckebaum | 52/584 |
| 3,380,768 | 4/1968 | Wolfensberger | 52/282 |
| 3,601,430 | 8/1971 | Zwennis | 287/54 |
| 3,654,851 | 4/1972 | Bertin | 52/656 |
| 3,767,237 | 10/1973 | Suchowski | 403/402 |

FOREIGN PATENT DOCUMENTS

| | | | |
|---|---|---|---|
| 972,215 | 8/1950 | France | 403/401 |

*Primary Examiner*—Price C. Faw, Jr.
*Assistant Examiner*—Carl D. Friedman
*Attorney, Agent, or Firm*—Nolte and Nolte

[57] ABSTRACT

An extruded rail comprises a body having a longitudinally extending flat side surface, an L-sectioned channel extending longitudinally through the rail and having one limb parallel to said side surface, and another limb extending from a junction with an end region of said one limb, at an angle to said side surface and to that side of said one limb remote from said side surface, various elements for connecting such rails are also illustrated.

16 Claims, 20 Drawing Figures

FIG.2.
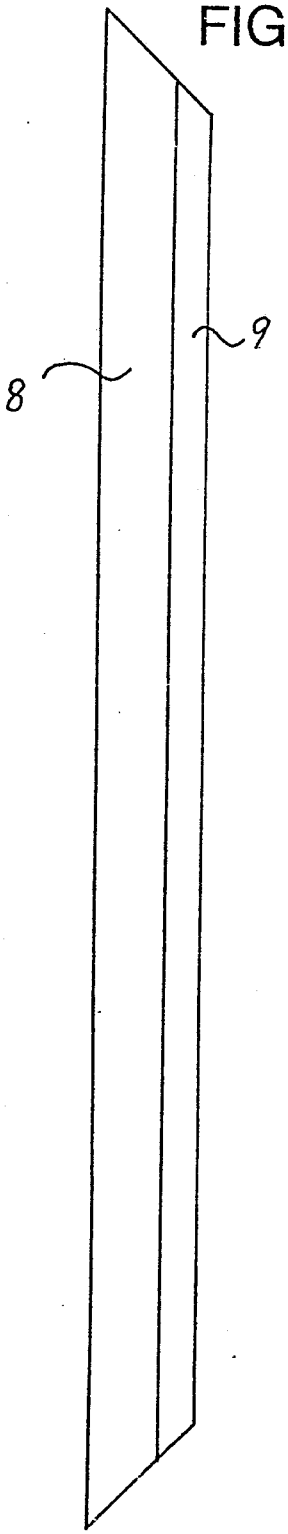
FIG.1.
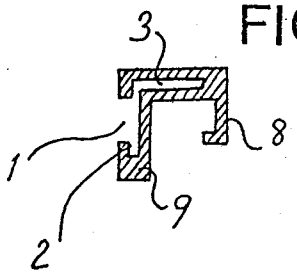
FIG.3.
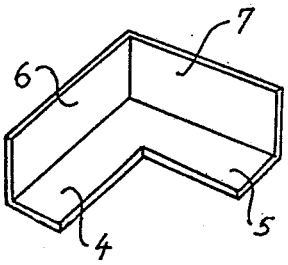
FIG.5.
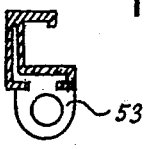
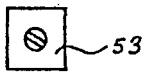
FIG.6.

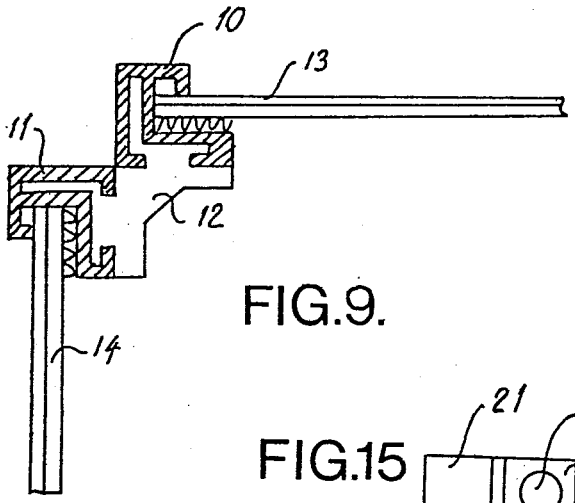
FIG.9.
FIG.15
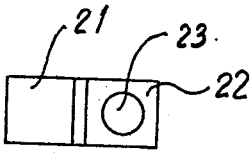
FIG.13
FIG.14
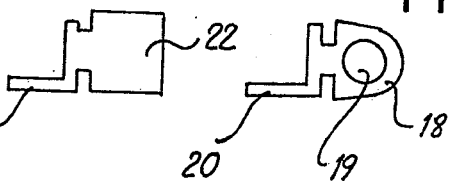
FIG.12
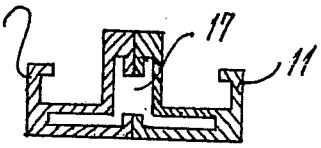
FIG.11
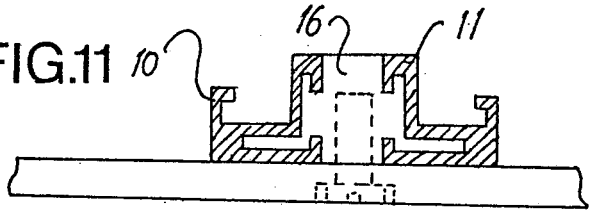
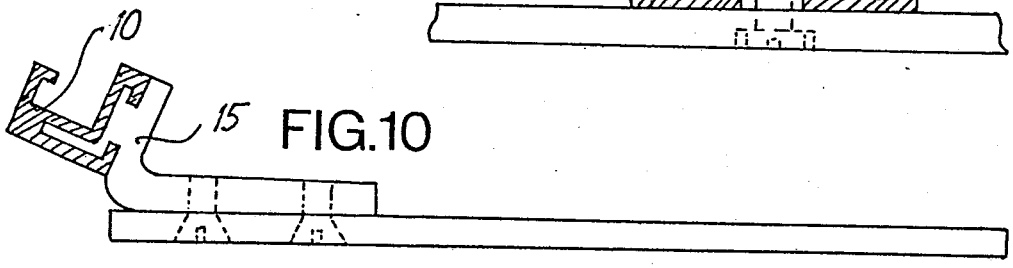
FIG.10

PROFILE RAIL

BACKGROUND OF THE INVENTION

The invention relates to a profile rail, particularly of extruded aluminium and of the type, which in one side face has a slot leading in to a channel formed within the rail and extending to both sides of the slot.

Such rails are for instance used in frames and other constructions where two rails should be interconnected so as to form a 90° corner. The ends of the rails to be joined are mitered and are interconnected by means of an L-shaped connector element of which the legs are inserted into corresponding ones of slots of the rails. However, for many uses there is a necessity for constructions having higher strength and rigidity than can be obtained by means of the previously known rails of the type stated.

It is the object of the invention to provide a rail of the type stated by means of which it is possible to make constructions which are not much more expensive than previously known constructions of the same type, but have higher strength and rigidity than the latter.

BRIEF SUMMARY OF THE INVENTION

According to the invention there is provided an extruded rail comprising a body having a longitudinally extending flat side surface, an L-sectioned channel extending longitudinally through the rail and having one limb parallel to said side surface and another limb extending from a junction with an end region of said one limb, at an angle to said side surface and to that side of said one limb remote from said side surface, and a longitudinal slot opening from said side surface to said one limb at a region spaced from said junction of said limbs, said side surface extending to both sides of said slot.

DESCRIPTION OF THE FIGURES OF THE DRAWINGS

In the following, the invention is explained in detail with reference to the drawings, in which:

FIG. 1 shows a cross section through an embodiment according to the invention;

FIG. 2 is a construction-part manufactured of the rail shown in FIG. 1 and intended for the construction of rectangular frames;

FIG. 3 shows a corner piece or connector element for use with the rail of FIG. 2;

FIGS. 5 and 6 show details of the frame of FIG. 4;

FIG. 9 shows a construction with an assembly of two frames, which are constructed of rails according to the invention;

FIGS. 10, 11 and 12 show three different assemblies using the rail shown in FIG. 1;

FIG. 13 shows a connecting element for use with the rail according to the invention;

FIGS. 14 and 15 show a different connector element for use with rails according to this invention;

DESCRIPTION OF THE PREFERRED EMBODIMENTS

Figure 4:
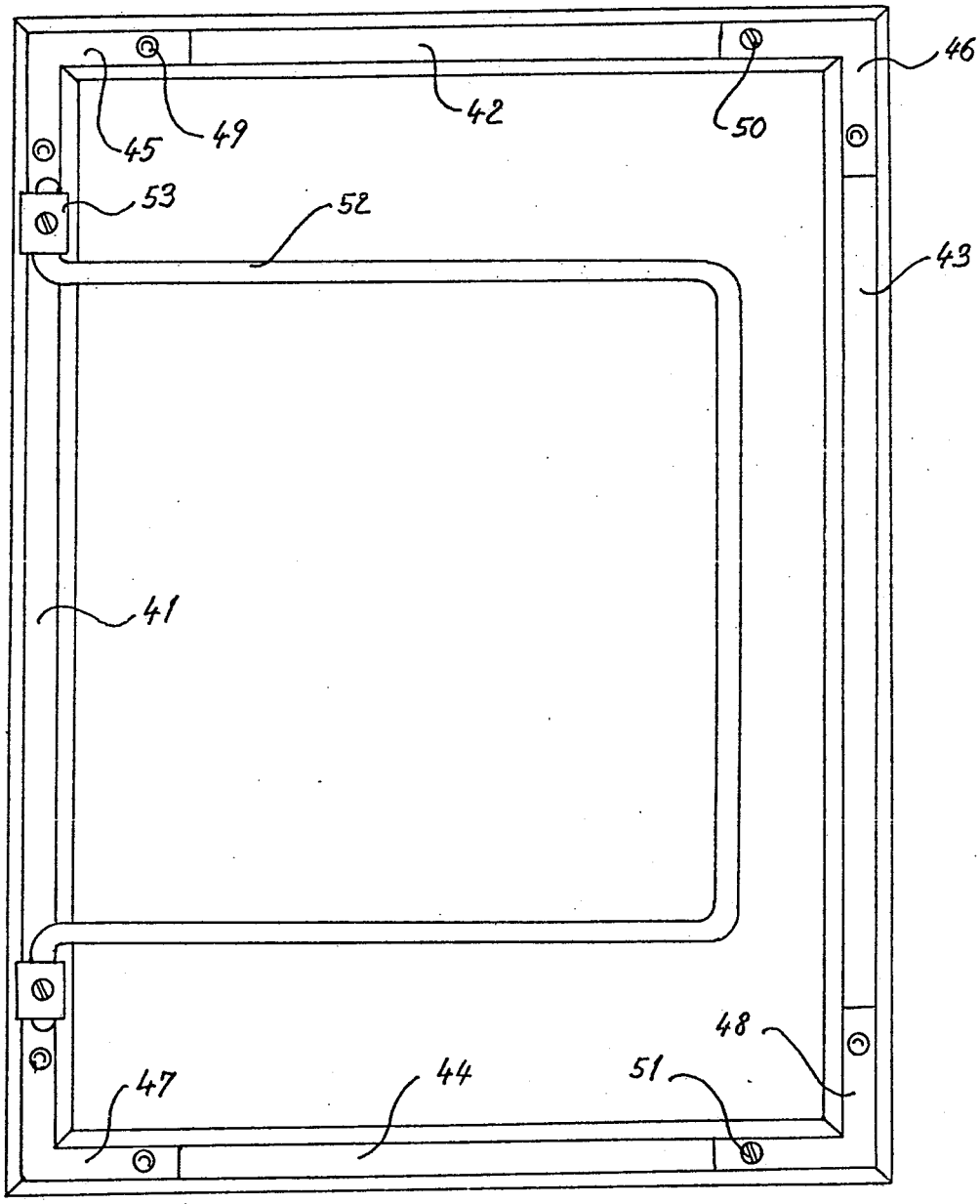
FIG. 4 shows a picture frame constructed of rails according to the invention.

The rail shown in FIG. 1 is of inverted U-form with a long rear leg 9 and a short front leg 8. In the rear side of the rail is made a longitudinal slot 1, leading to an angular groove or L sectioned channel with a branch or limb 2, extending on both sides of the slot 1 and a branch or limb 3 at right angles to the branch 2.

Frames can be manufactured of such rails by cutting them into appropriate lengths having mitered ends as shown in FIG. 2. Four such parts can be assembled to a very rigid and solid frame by connecting the lengths by means of the angular connecting elements shown in FIG. 3, the parts 4 and 5 being inserted into the limb 2 of each of the two rails, whereas each of the parts 6 and 7 are inserted into the limb 3. After assembly of the frame the angular pieces can be fastened by means of screws inserted through the slot 1 in threaded holes (not shown) in the parts 4 and 5 and bearing against the back of the legs 9 of the rails.

Figure 7:
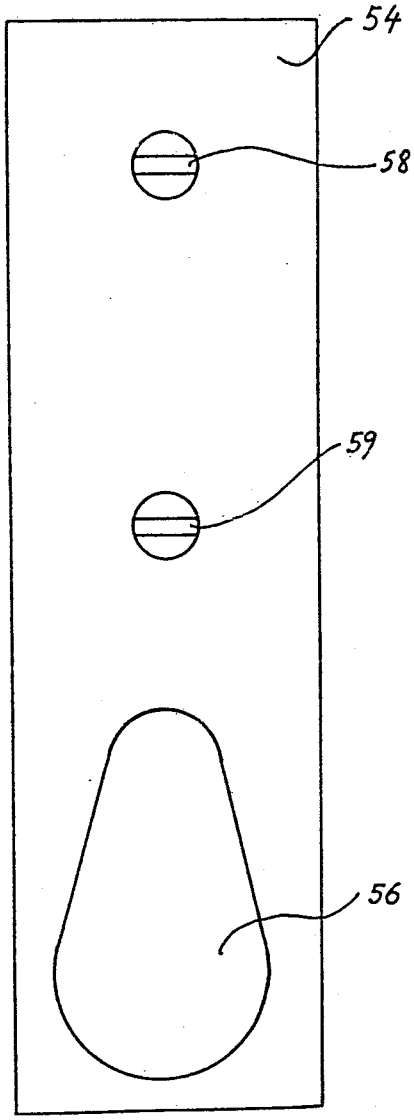
FIGS. 7 and 8 show a fitting for the suspension of the frame shown in FIG. 4.
Figure 8:
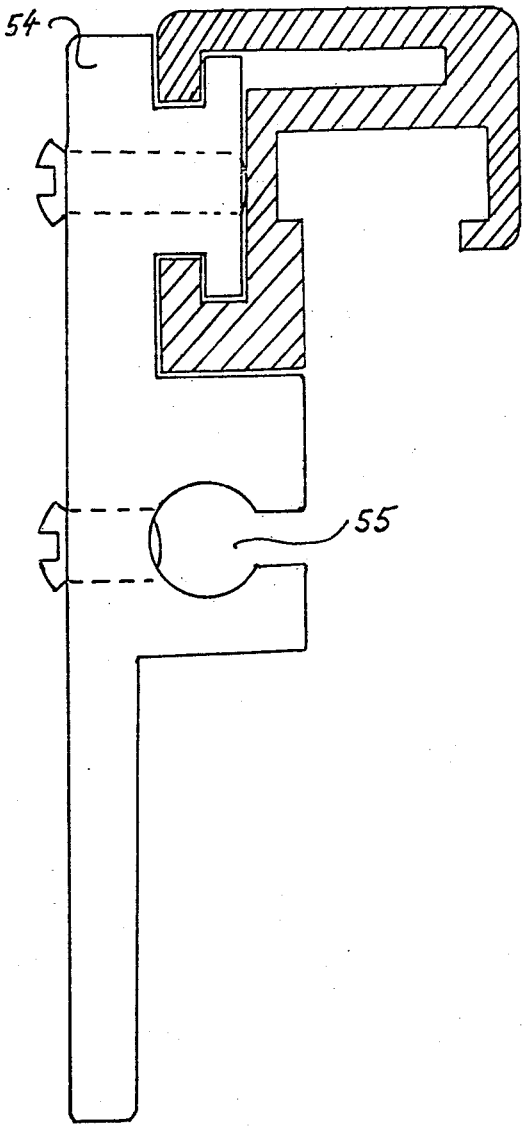

In FIG. 4 there is shown a frame manufactured of four rails 41–44 of the type shown in FIG. 2, interconnected in the corners by means of four angular pieces 45–48 of the type shown in FIG. 3. In the case of small frames manufactured of relatively thin-walled rails the angular pieces can be fixed in the rails by pressing a wall of the rails into the holes 49 of the angular pieces, except in two places where the connection is secured by means of screws 50 and 51, so that the frame at said places can be disassembled and a picture inserted. A bow 52 can be fastened to the frame by inserting it in two bow fittings, shown in detail in FIGS. 5 and 6, and fixed in a desired inclined position by fastening a screw in each bow fitting. For the suspension of the frame fittings 54 can be used as shown in FIGS. 7 and 8. The fittings 54 can, as the fittings 53, be manufactured of extruded aluminium, and are made with a hole 56 for the suspension of the frame. Furthermore, the fitting has a recess 55 for the insertion of the bow 52 so that the fittings are interchangeable. In the fitting screws 57 and 58 are located to fasten the bow 52 in the fitting and the fitting to the frame.

In FIG. 9 two frames are shown having rails 10 and 11, each holding a glass plate, 13, 14, respectively, and assembled in a 90° corner by means of a connecting piece 12 which has legs inserted into the L-sectioned channels of the two rails and which keep the rails with the two longitudinal edges adjoining each other.

In FIG. 10 there is shown a construction with a frame having a rail 10 fastened in an oblique position to a bottom part made of plastic plate by means of a connecting piece 15 with an L-sectioned projection which is inserted into the channel of the rail.

In the construction shown in FIG. 11 two frames 10 and 11 are assembled with their backs facing each other by means of a connecting piece 16 having two L-sectioned projections which are inserted in the angular channels of the rails and the connecting piece is screwed to a plate.

In the construction shown in FIG. 12 the frames with the rails 10 and 11 are assembled having their back faces adjoining each other, by means of an appropriate connecting piece 17, having L-sectioned projections inserted into the channels of the rails.

In FIG. 13 is shown a pivot fitting 18 having an L-sectioned projection 20 which can be inserted into the angular channel of a rail according to the invention to secure the rail for pivotal movement about a pin inserted in a hole 19 in the fitting 18.

In FIGS. 14 and 15 is shown another pivot fitting 22 having an L-sectioned projection 21 which can be inserted into the channel of a profile rail according to the invention and secure the rail for pivotal movement about a pin inserted into a bore 23 in the fitting 22.

The fitting shown in FIG. 13 and the fitting shown in FIGS. 14 and 15 can be used instead of the fitting 53 for mounting the bow 52 upon the frame shown in FIG. 4, by fastening in the upper rail 41 of the frame or in the to side rails 42 and 44.

Figure 16:
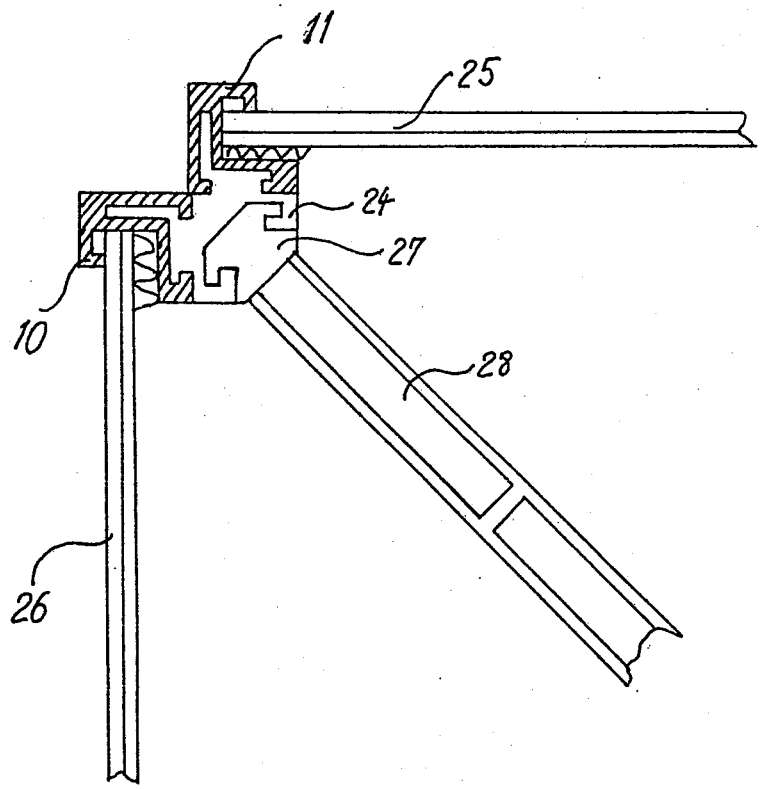
FIG. 16 shows a corner construction including rails according to this invention.
Figure 17:
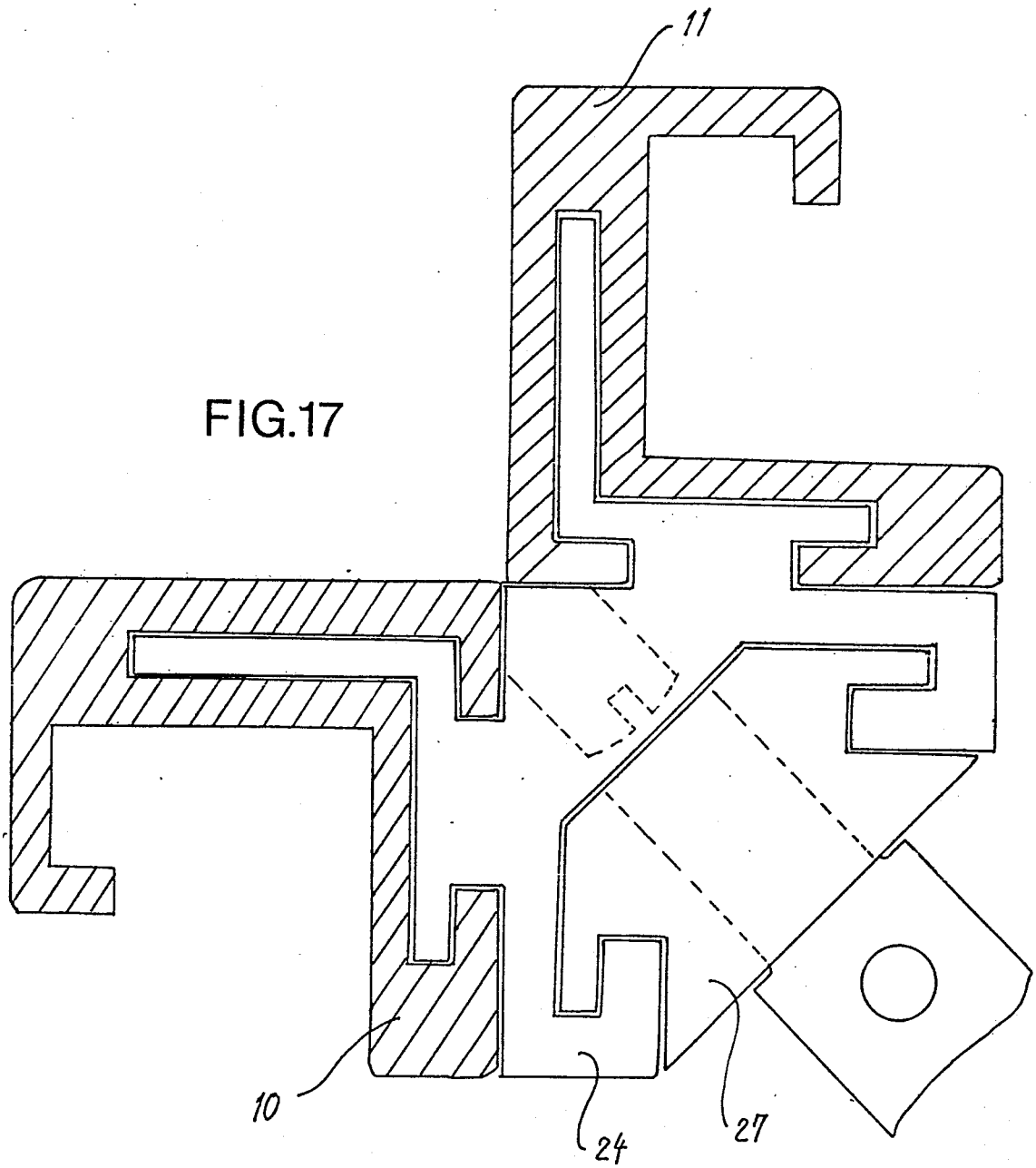
FIG. 17 is a cross section on a larger scale of the corner construction shown in FIG. 16.

In FIG. 16 two frames are shown, with rails 10 and 11, each holding a glass plate 26, 25, respectively, and assembled in a 90° corner by means of a connecting piece 24 with L-sectioned projections inserted into the channels of the rails so that the rails are held together with two longitudinal edges adjacent each other. The connecting piece is also used for fastening a further connecting piece 27 which is inserted into the piece 24. The connecting piece 27 is used for fastening a construction part 28 along the bisector line of the corner. The corner assembly is shown on a larger scale in FIG. 17.

Such constructions can for instance be used for making glass showcases by means of frames made of rails according to the invention.

Figure 18:
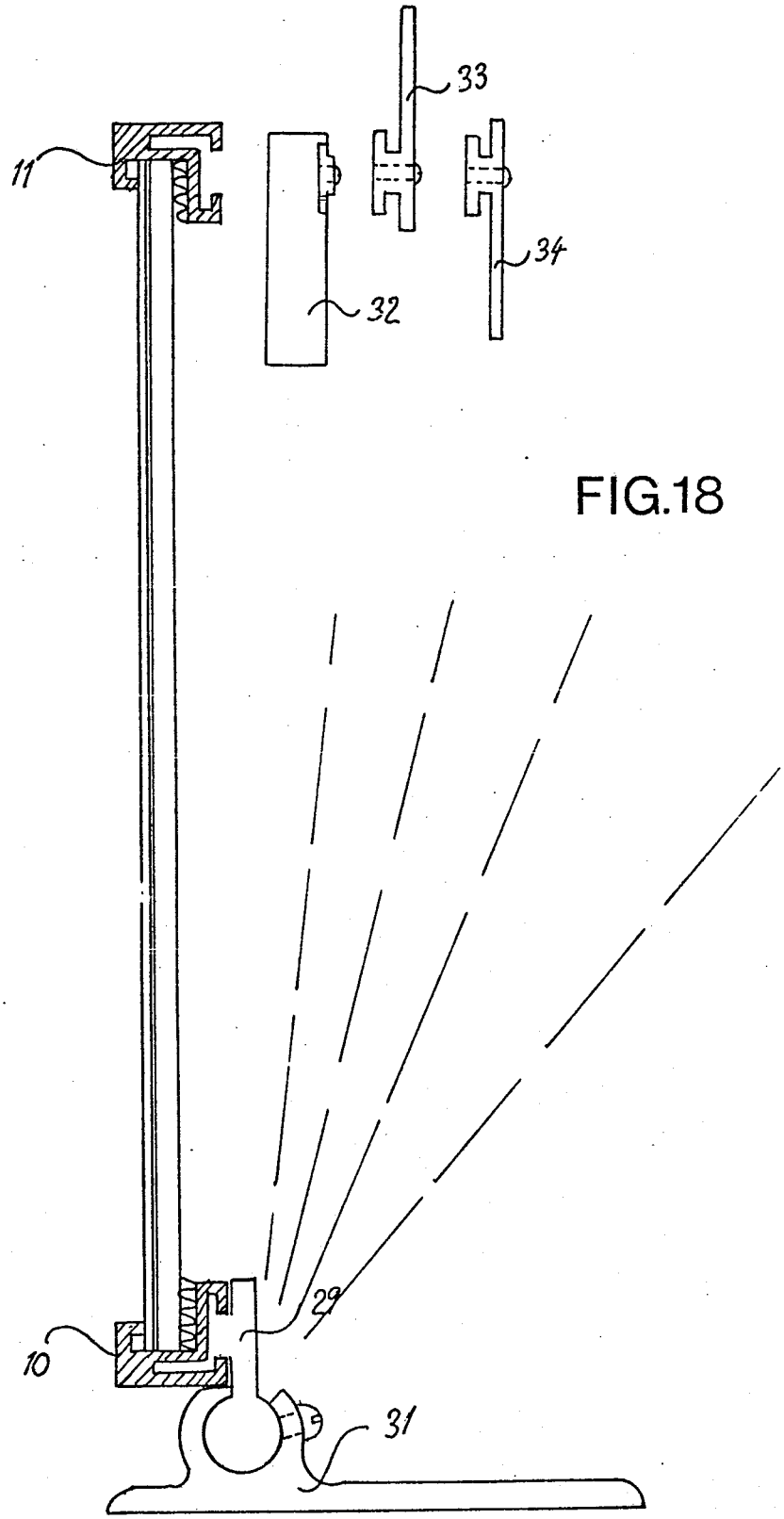
FIGS. 18 and 19 show two constructions using the rails of this invention.

In the construction shown in FIG. 18 a frame of profile rails according to the invention with a plate fastened therein is pivotally connected to a foot piece 31 by means of a pivot fitting 29 having a projection inserted in a bearing in the foot piece 31 and an L-sectioned projection inserted into the channel in the rail 10. The frame can be fixedly held in a desired position by means of a screw inserted in the foot piece 31, as shown. The channel in the other rail 11 can be used for mounting fittings 32, 33 or 34 for suspending the frame.

Figure 19:
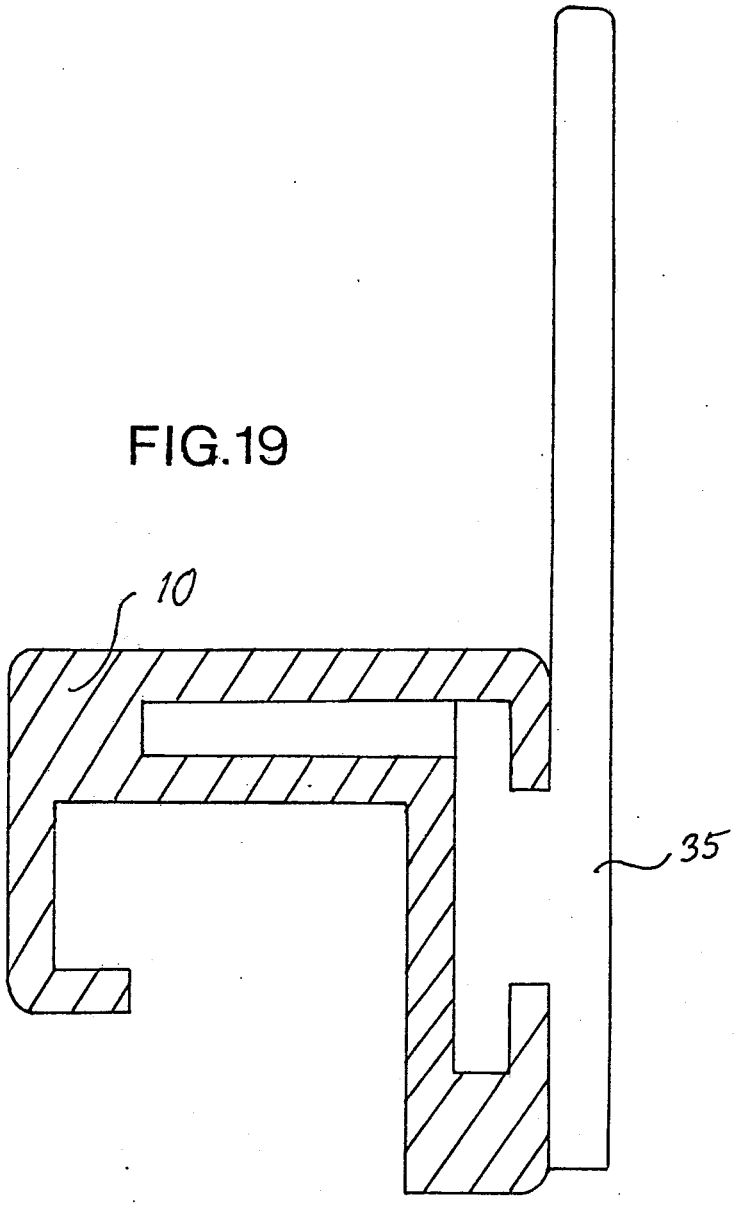
Figure 20:
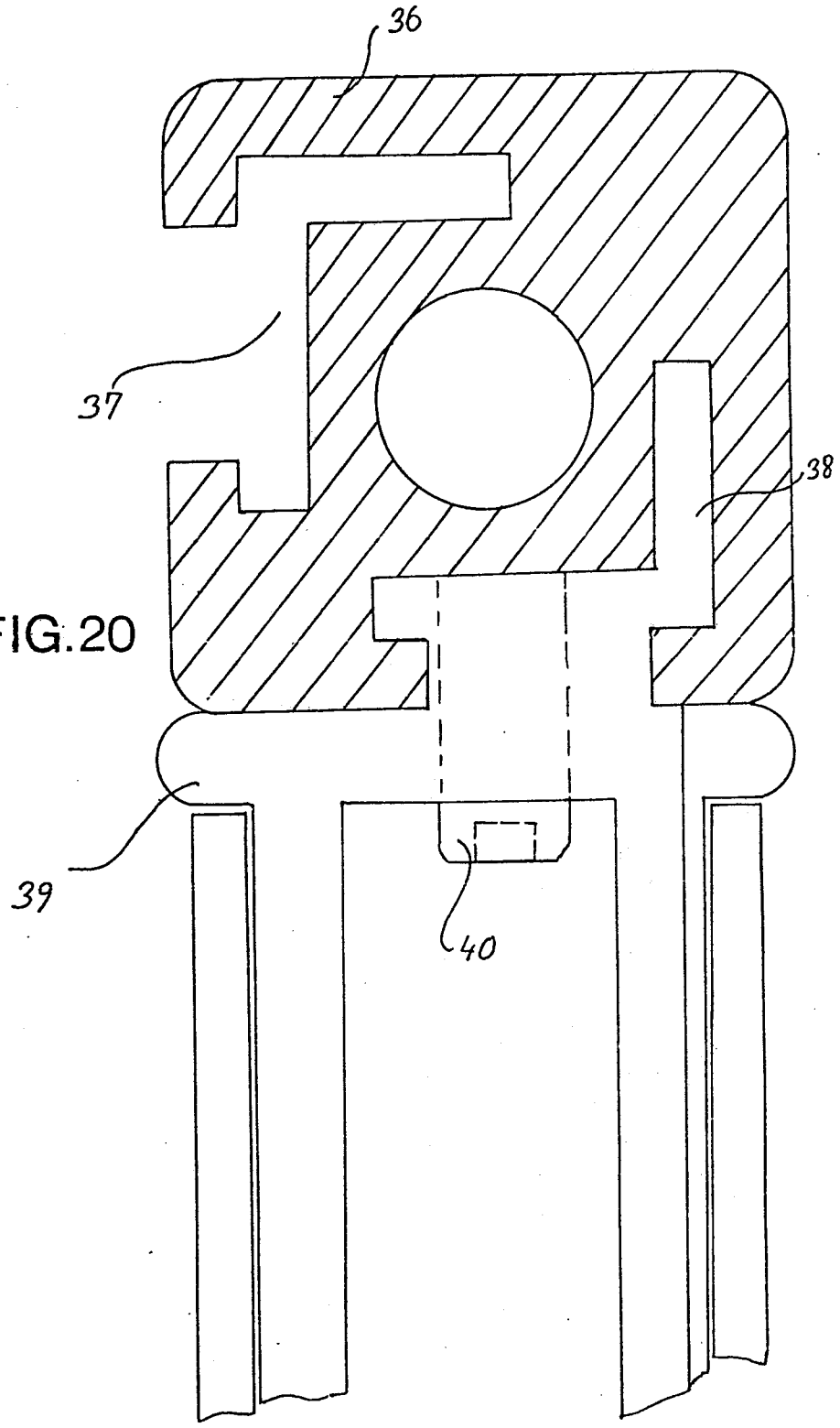
FIG. 20 shows an alternative embodiment of the rail according to the invention.

In FIG. 19, a fitting 35 is shown corresponding to the fitting 33 for suspending the frame.

The embodiments of the invention in which an exclusive property or privilege is claimed are defined as follows:

1. An extruded rail comprising a body having a longitudinally extending flat side surface, an L sectioned channel extending longitudinally through the rail and having one limb parallel to said side surface and another limb extending from a junction with an end region of said one limb, at an angle to said side surface and to that side of said one limb remote from said side surface, and a longitudinal slot opening from said side surface to said one limb at a region spaced from said junction of said limbs, said side surface extending to both sides of said slot.

2. A rail as claimed in claim 1 wherein said other limb extends at approximately 90° from said side surface.

3. An extruded rail as claimed in claim 2 wherein said limbs are of substantially similar length.

4. An extruded rail as claimed in claim 2 including a removable connector element having a cross section similar to said channel and releasably secured within said channel.

5. An extruded rail as claimed in claim 1 wherein said limbs are of substantially similar length.

6. An extruded rail as claimed in claim 5 including a removable connector element having a cross section similar to said channel and releasably secured within said channel.

7. A rail as claimed in claim 1 wherein said body is provided with two such L-shaped channels and two such longitudinal slots, said slots being disposed at an angle to each other.

8. An extruded rail as claimed in claim 1 including a removable connector element having a cross section similar to said channel and releasably secured within said channel.

9. In combination, an extruded rail comprising a body having a longitudinally extending flat side surface, an L sectioned channel extending longitudinally through said rail and having one limb parallel to said side surface and another limb extending from a junction with an end region of said one limb at an angle to said surface and to that side of said one limb remote from said side surface, an end region of said one limb remote from said junction being closed and a longitudinal slot opening from said side surface to said one limb at a region intermediate said closed end region and said junction and a connector piece comprising a longitudinally extending portion of similar cross section to said channel, said longitudinally extending portion being received within said channel.

10. The combination as claimed in claim 9 comprising a second rail of similar cross section to said first rail and in end-to-end relationship with said first rail, said connector element having a further section of similar cross section to said channel and received within said channel of said second rail.

11. The combination as claimed in claim 10 wherein said connector piece includes a portion extending through at least one of said slots of said rails.

12. The combination as claimed in claim 9 wherein adjacent ends of said rails are mitred and said sections of said connector piece are angled to fit within said channels.

13. The combination as claimed in claim 9 wherein said connector element includes a portion extending through said slot.

14. An extruded rail comprising a body having a longitudinally extending flat side surface, an L-sectioned channel extending longitudinally through the rail and having one limb parallel to said side surface and another limb extending from a junction with an end region of said one limb, at an angle to said side surface and to that side of said one limb remote from said side surface, an end region of said one limb remote from said junction being closed and a longitudinal slot opening from said side surface to said one limb at a region intermediate said closed end region and said junction.

15. An extruded rail comprising a body having a longitudinally extending flat side surface, an L-sectioned channel extending longitudinally through the rail and having one limb parallel to said side surface and another limb extending from a junction with an end region of said one limb, at an angle to said side surface and to that side of said one limb remote from said side surface and a longitudinal slot opening from said side surface to said one limb at a region spaced from said junction of said limbs, said slot and said one limb defining a generally T-shaped channel.

16. In combination, an extruded rail comprising a body having a longitudinally extending flat side surface, an L-sectioned channel extending longitudinally through said rail and having one limb parallel to said side surface and another limb extending from a junction with an end region of said one limb at an angle to said surface and to that side of said one limb remote from said side surface and a longitudinal slot opening from said side surface to said one limb at a region spaced from said junction of said limbs, said side surface extending to both sides of said slot and said one limb and said slot defining a generally T-shaped channel, and a connector piece comprising a longitudinally extending portion of similar cross section to said channel said longitudinally extending portion being received within said channel.

* * * * *